US006402342B1

(12) United States Patent
Chiang

(10) Patent No.: US 6,402,342 B1
(45) Date of Patent: Jun. 11, 2002

(54) COLD-LIGHT EMITTING FRISBEE

(76) Inventor: Kuo-Pin Chiang, No. 30-5, Sheling, Yuanli Jen, Miaoli Hsien (TW)

( * ) Notice: Subject to any disclaimer, the term of this patent is extended or adjusted under 35 U.S.C. 154(b) by 0 days.

(21) Appl. No.: 09/846,299

(22) Filed: May 2, 2001

(51) Int. Cl.[7] ..... F21L 4/02

(52) U.S. Cl. ..... 362/253; 362/184; 362/234; 446/47

(58) Field of Search ..... 362/184, 253, 362/267, 806, 84, 234; 446/46, 47, 242, 485; 273/424, 428; 473/570, 588

(56) References Cited

U.S. PATENT DOCUMENTS 3,786,246 A * 1/1974 Johnson et al. ..... 362/184
5,032,098 A * 7/1991 Balogh et al. ..... 446/47
5,319,531 A * 6/1994 Kutnyak ..... 362/184

* cited by examiner

*Primary Examiner*—Y. My Quach-Lee
(74) *Attorney, Agent, or Firm*—Birch, Stewart, Kolasch & Birch, LLP

(57) ABSTRACT

A cold-light emitting Frisbee mainly includes a transparent round top cover, a round base covered by the top cover, and a cold-light emitting means. The round base is provided at a central area with open-bottomed battery compartments to accommodate batteries therein, and at an upper surface with radially spaced recesses. The cold-light emitting means includes a control plate and some cold-light strips connected to the control plate via flat cables and fitly positioned in the radial recesses. The control plate is fixed to the upper surface of the base to electrically connect to the batteries in the battery compartments. A user may push a watertight sealing member from a bottom of the base to actuate a pressure switch on the control plate, causing the cold-light strips to emit cold light when the Frisbee is thrown out to fly and turn in the air.

4 Claims, 3 Drawing Sheets

COLD-LIGHT EMITTING FRISBEE

BACKGROUND OF THE INVENTION

The present invention relates to a Frisbee, and more particularly to a Frisbee that has a cold-emitting means mounted between a transparent top cover and a base thereof to emit cold light and therefore create special visual effect when the Frisbee flies and turns in the air.

Frisbees are popular throwing toys and can be divided into different types according to their sizes, weights, shapes and purposes, such as mini Frisbees, auto-return Frisbees, practicing Frisbees, Frisbees for aimed throwing, and Frisbees for distant throwing. There are also other specially designed Frisbees suitable for creating different performing effects.

While the amazing throwing skill of a Frisbee player is a very important factor for the Frisbee to become an attractive toy, the structure of the Frisbee itself is another important factor that enables the Frisbee to create special visual effect and attract more consumers. It is tried by the inventor to incorporate a cold-light emitting means in the structure of a Frisbee, so that cold light is emitted when the Frisbee is thrown out to fly and turn in the air to create a dazzling visual effect and effectively and exactly show how wonderful a Frisbee player manipulates a Frisbee.

SUMMARY OF THE INVENTION

A primary object of the present invention is to provide a cold-light emitting Frisbee that mainly includes a transparent round top cover, a round base covered by the top cover, and a cold-light emitting means. The cold-light emitting means includes a control plate that is screwed to an upper surface of the base and is electrically connected to batteries received in compartments provided at a lower surface of the base, and some cold-light strips connected to the control plate via flat cables and fitly positioned in some recesses radially spaced on the upper surface of the base. A user may push a watertight sealing member from a bottom of the base to actuate a pressure switch on the control plate, causing the cold-light strips to emit cold light when the Frisbee is thrown out to fly and turn in the air.

Another object of the present invention is to provide a cold-light emitting Frisbee, of which a round base is provided at a central area with open-bottomed battery compartments to accommodate batteries therein. A packing strip is provided around a bottom opening of each battery compartment before the latter is closed with a covering plate, so that the batteries are completely protected against external moistures.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
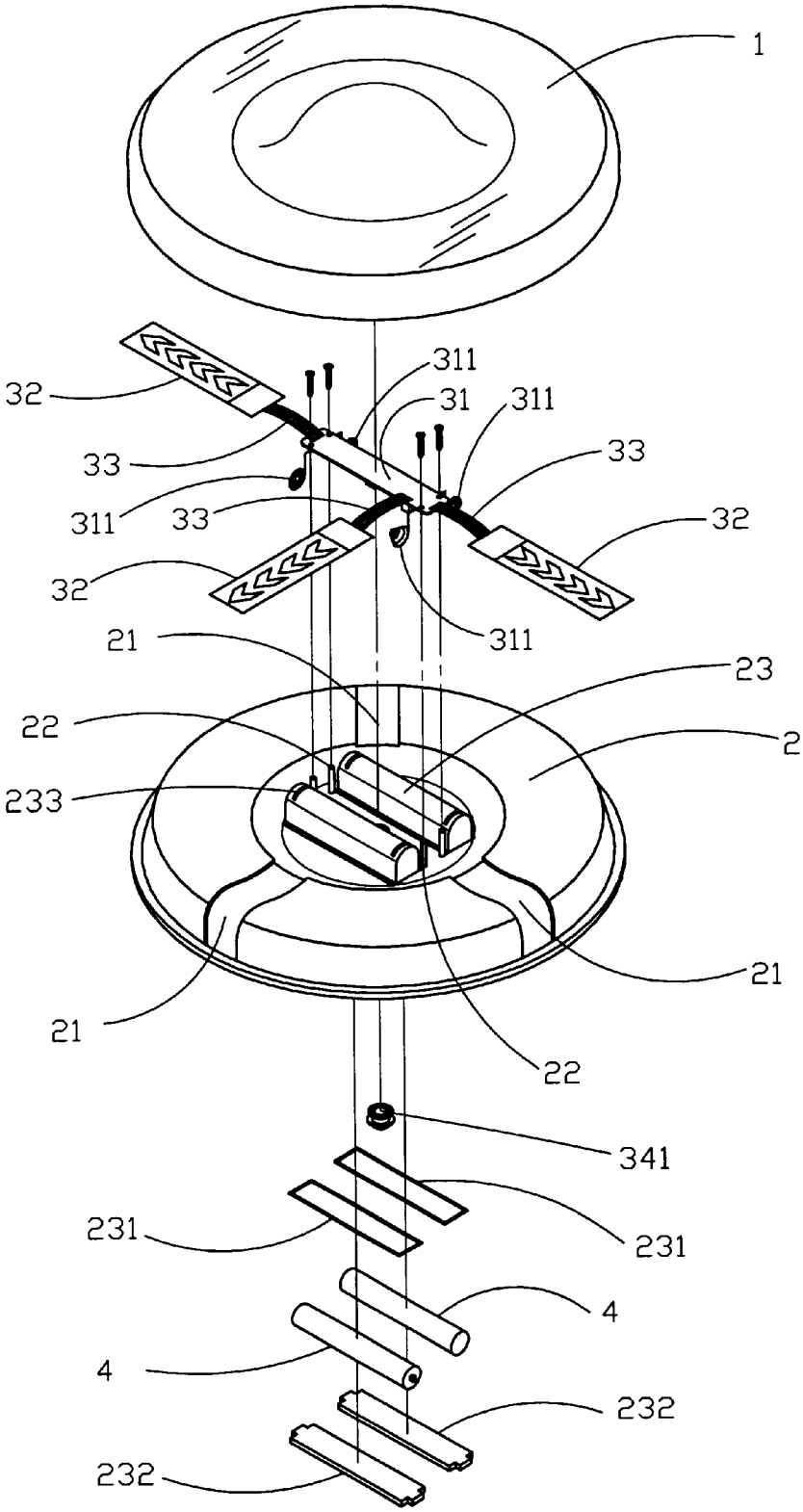
FIG. 1 is an exploded perspective view of a Frisbee according to the present invention.
Figure 2:
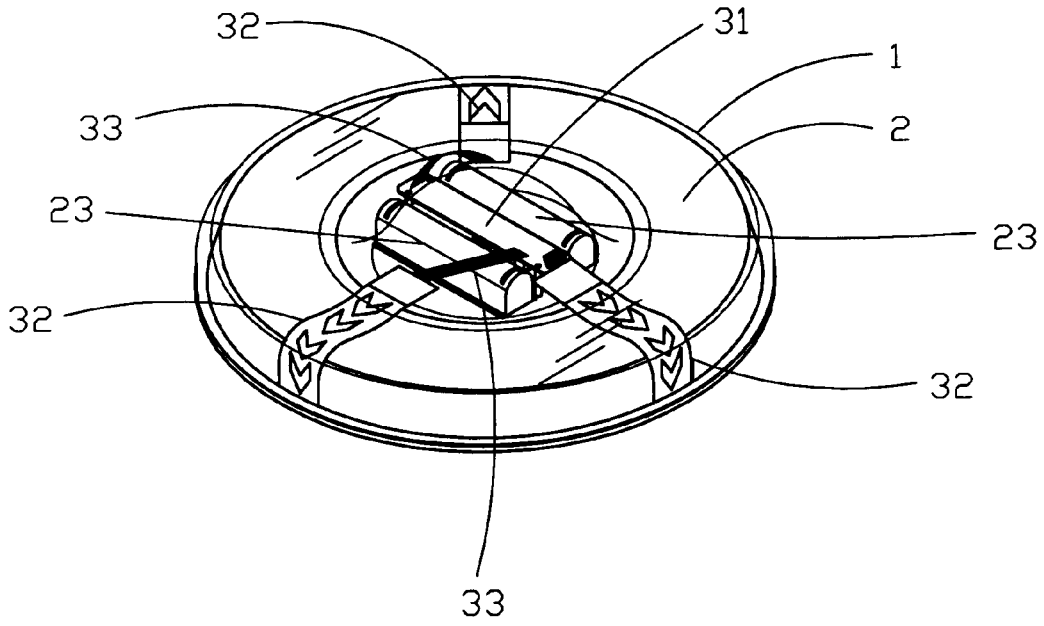
FIG. 2 is an assembled perspective view of the Frisbee of FIG. 1.

Please refer to FIGS. 1 and 2 that are exploded and assembled perspective views, respectively, of a Frisbee according to the present invention. As shown, the Frisbee mainly includes a top cover 1, a base 2, and a cold-light emitting means.

The top cover 1 is a transparent round member having an upward protruded central area.

Figure 3:
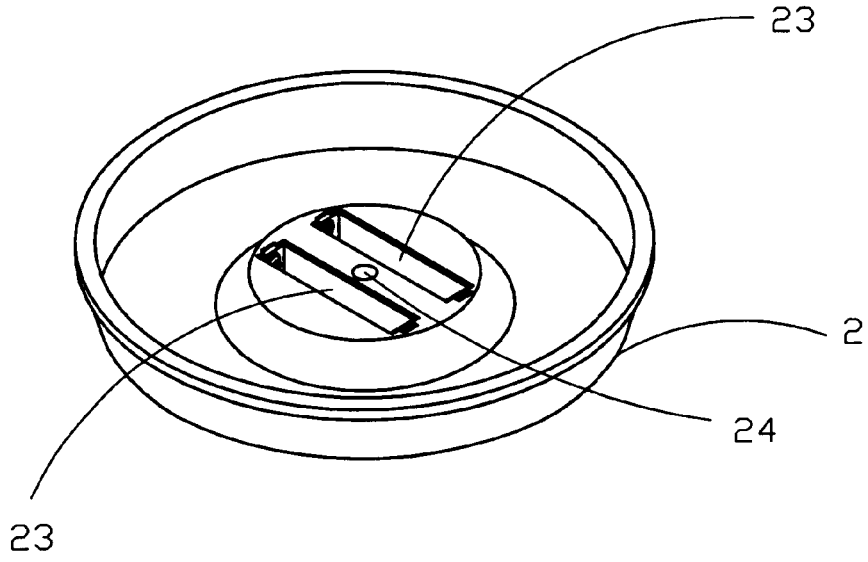
FIG. 3 is a perspective bottom view of a base of the Frisbee of the present invention.

The base 2 is a round member having a central recess. The base 2 is provided at an upper surface outside the central recess with a plurality of radially spaced recesses 21 and at predetermined positions with upward extended fixing bars 22. The central recess of the base 2 is formed of a predetermined number of open-bottomed battery compartments 23 and a through hole 24 (see FIG. 3). The battery compartments 23 are openably closed with covering plates 232 to seal batteries 4 in the battery compartments 23. Packing strips 231 are provided around lower openings of the battery compartment 23 before the latter are closed with the covering plates 232. Each battery compartment 23 is provided at two ends with two slots 233 to communicate an internal space of the battery compartment 23 with an external space above the base 2.

Figure 4:
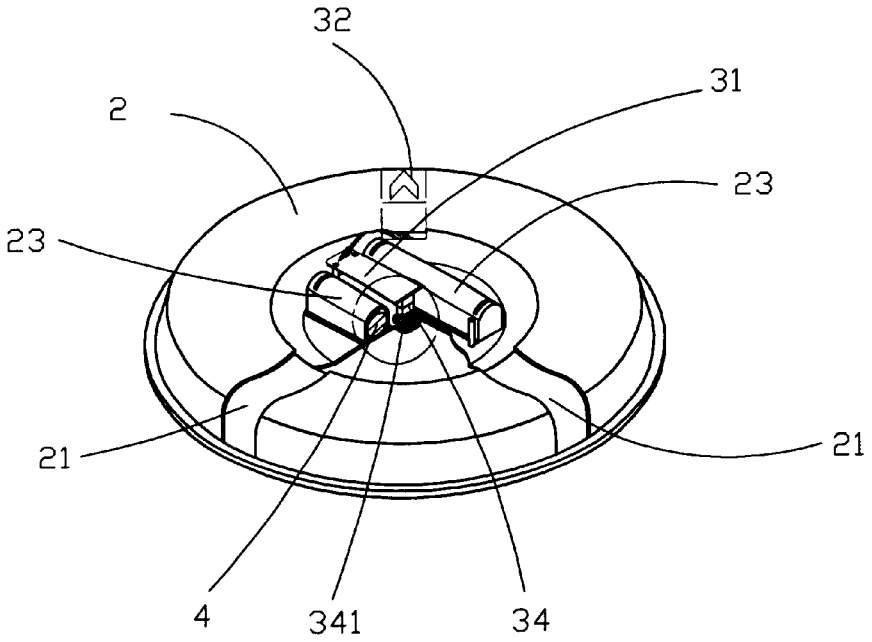
FIG. 4 is an assembled perspective view of the Frisbee of the present invention with a portion thereof cut away to show a pressure switch thereof.
Figure 4A:
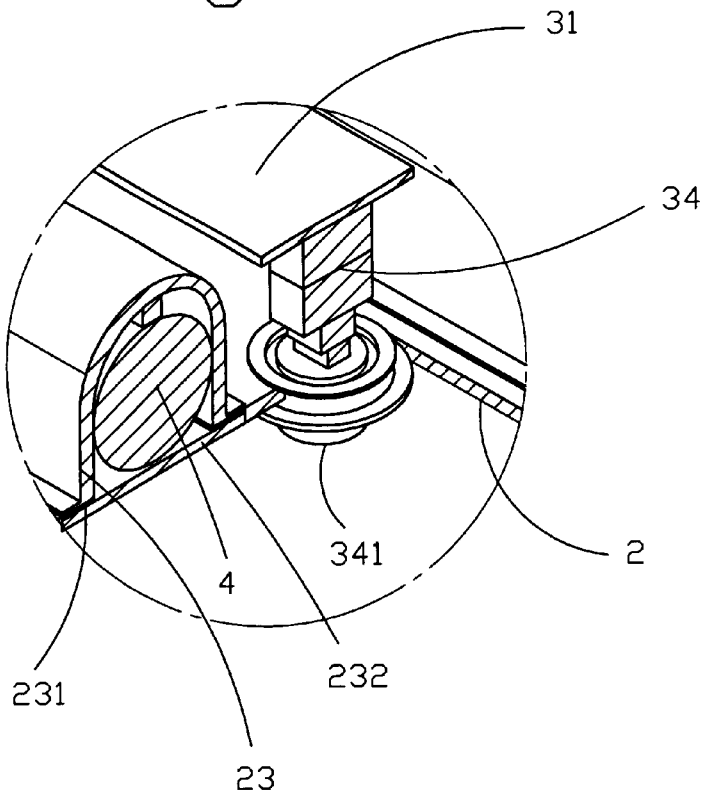
FIG. 4A is an enlarged view of the circled area of FIG. 4.

The light-emitting means includes a control plate 31 and a plurality of cold-light strips 32 electrically connected to the control plate 31 via flat cables 33. The number of the cold-light strips 32 corresponds to that of the radial recesses 21. The control plate 31 is provided at two ends with downward extended conductive plates 311 and at a bottom surface with a pressure switch 34 (see FIGS. 4 and 4A).

The control plate 31 of the light-emitting means is screwed to the fixing bars 22 on the upper surface of the base 2, so that the pressure switch 34 at an underside of the control plate 31 faces and aligns with the through hole 24 to contact with a watertight sealing member 341 fixedly mounted in the through hole 24, that the conductive plates 311 downward extended from two ends of the control plate 31 are adapted to extend into the battery compartments 23 via the slots 233 to electrically connect the control plate 31 to the batteries 4 mounted in the battery compartments 23, and that the cold-light strips 32 are separately fitly laid in the radial recesses 21. The top cover 1 is then tightly closed onto the upper surface of the base 2 to complete a cold-light emitting Frisbee of the present invention.

When playing the Frisbee of the present invention, a player may push the watertight sealing member 341 from a bottom of the base 2 to actuate the pressure switch 34, so that the cold-light strips 32 of the light-emitting means emit cold light through control of a circuitry provided on the control plate 31. Such cold light creates dazzling and attractive visions when the Frisbee is thrown out to fly and turn in the air, making the Frisbee more interesting for playing.

It is possible the Frisbee undesirably falls into water when it is thrown out. In this case, the packing strips 231 mounted around the bottom opening of the battery compartments 23 together with the covering plates 232 effectively stop any water from entering into the battery compartments 23 to cause any short circuit in the Frisbee. Similarly, the watertight sealing member 341 completely seals the through hole 24 without hindering the actuation of the pressure switch 34 via pushing of the watertight sealing member 341 mounted in the through hole 24. That is, the pressure switch 34 is indirectly controlled through the watertight sealing member 341.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A cold-light emitting Frisbee, comprising a top cover, a base, and a cold-light emitting means;

said top cover being a transparent round member having an upward protruded central area;

said base being a round member having a central recess, said base being provided at an upper surface outside said central recess with a plurality of radially spaced recesses and at predetermined positions with fixing bars, said central recess having a predetermined number of open-bottomed battery compartments and a through hole, each said battery compartment being provided around a bottom opening thereof with a packing strip, allowing a battery to be sealed in each said battery compartment with said bottom opening closed with a covering plate, and said through hole being sealed with a watertight sealing member; and said cold-light emitting means including a control plate and a plurality of cold-light strips electrically connected to said control plate via flexible flat cables, said control plate being provided at two ends with downward extended conductive plates and at an underside with a pressure switch;

whereby by screwing said control plate to said fixing bars on said base with said pressure switch facing and aligning with said through hole provided on said base, said conductive plates downwardly extended from said control plate to said battery compartment and electrically connecting said control plate to said batteries in said battery compartments, and said cold-light strips fitly disposed in said radial recesses on the upper surface of the base, and then closing and connecting said transparent top cover onto the upper surface of said base, said cold-light emitting Frisbee is completed for use.

2. The cold-light emitting Frisbee as claimed in claim 1, wherein said base is provided with one battery compartment.

3. The cold-light emitting Frisbee as claimed in claim 1, wherein said base is provided with more than one battery compartment.

4. The cold-light emitting Frisbee as claimed in claim 1, wherein each said battery compartment is provided at two ends with two slots via which said conductive plates of said control plate are extended into said battery compartment to electrically connect said control plate to said battery in said battery compartment.

* * * * *